US009499996B2

(12) United States Patent
Johnson et al.

(10) Patent No.: US 9,499,996 B2
(45) Date of Patent: Nov. 22, 2016

(54) WATER REMOVAL FROM FLEXIBLE COVER

(71) Applicant: Latham Pool Products, Inc., Latham, NY (US)

(72) Inventors: Ronald Leon Johnson, San Jose, CA (US); Steven Simas Escobar, San Jose, CA (US); Yugen Patrick Lockhart, Palo Alto, CA (US); Kevin Losee, Payson, UT (US); John Patton, Lehi, UT (US)

(73) Assignee: Latham Pool Products, Inc., Latham, NY (US)

( * ) Notice: Subject to any disclaimer, the term of this patent is extended or adjusted under 35 U.S.C. 154(b) by 273 days.

(21) Appl. No.: 14/317,983

(22) Filed: Jun. 27, 2014

(65) Prior Publication Data

US 2015/0000764 A1 Jan. 1, 2015

Related U.S. Application Data

(60) Provisional application No. 61/839,980, filed on Jun. 27, 2013.

(51) Int. Cl.

| | |
|---|---|
| ***E04H 4/14*** | (2006.01) |
| ***F17D 1/14*** | (2006.01) |
| *E04H 4/10* | (2006.01) |

(52) U.S. Cl.

CPC *E04H 4/14* (2013.01); *F17D 1/14* (2013.01); *E04H 4/10* (2013.01); *Y10T 137/6851* (2015.04)

(58) Field of Classification Search

CPC ..... E04H 4/10; E04H 4/101; E04H 4/108; E04H 4/14; F17D 1/14; B65D 88/38

USPC ..... 4/498, 500, 502

See application file for complete search history.

(56) References Cited

U.S. PATENT DOCUMENTS

| | | | | |
|---|---|---|---|---|
| 4,214,671 | A * | 7/1980 | McKibbin | B65D 88/38 220/219 |
| 4,722,110 | A * | 2/1988 | Chandler | A47L 7/0009 15/1.7 |
| 4,853,984 | A * | 8/1989 | Celiano | E04H 4/10 137/132 |
| 6,058,540 | A * | 5/2000 | Ryall | F04F 10/00 15/1.7 |
| 6,945,267 | B1 * | 9/2005 | Tedona | F04F 10/00 137/132 |
| 6,954,948 | B1 * | 10/2005 | Asack | E04H 4/10 4/498 |

(Continued)

OTHER PUBLICATIONS

Wayne/Scott Fetzer Company, Auto On-Off Water Removal Pool Cover Pump, Operation Instructions & Parts Manual, Aug. 2012, 20 pages.

(Continued)

*Primary Examiner* — J. Casimer Jacyna

(74) *Attorney, Agent, or Firm* — Kilpatrick Townsend & Stockton LLP

(57) ABSTRACT

An automatically deployed water removal apparatus for use with a solid, flexible swimming pool cover to remove rainwater caught by the cover. In one embodiment, a head with a water inlet pivots from a stored position along the edge of a pool to a deployed position near the center of a deployed cover as the cover advances to its deployed, pool-covering position. In another embodiment, a water inlet is attached to and positioned in part by a tether cord that may be reeled out during cover deployment and reeled in during retraction of the cover.

11 Claims, 8 Drawing Sheets

(56) References Cited

U.S. PATENT DOCUMENTS

| | | | | |
|---|---|---|---|---|
| 7,963,412 | B1 * | 6/2011 | Curtiss | B65D 88/38 220/216 |
| 2014/0157508 | A1 * | 6/2014 | Drechsel | E04H 4/10 4/498 |

OTHER PUBLICATIONS

Rule, Fully Automatic Pool Cover Drain Pump—Model H53SP-24, Instruction Guide, 2009, 2 pages.

* cited by examiner

WATER REMOVAL FROM FLEXIBLE COVER

CROSS-REFERENCE TO RELATED APPLICATION

This patent claims priority to U.S. Provisional Patent Application Ser. No. 61/839,980, filed Jun. 27, 2013, which is incorporated herein in its entirety by reference.

FIELD OF THE INVENTION

This disclosure relates to devises and techniques for removing water from flexible covers for tanks, including covers for swimming pools.

BACKGROUND

Flexible, water impermeable swimming pool covers and similar covers for other tanks, pools and the like provide safe and effective covers. However, rain water often collects on such covers and can damage the cover and present a drowning hazard, particular for children and animals, because of water that pools on top of the cover. Accordingly, it is often desirable to remove such water that has collected on a cover or within a vault or other structure within which such a cover may be stored. Pumps for such water removal are available, but they must be placed on the cover by a user and removed before the cover is closed, which may be neither easy to remember nor to do, particularly, for instance, if it is raining.

SUMMARY

The terms "invention," "the invention," "this invention," "the present invention" and "disclosure" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

A water removal pump or pump inlet device may be automatically deployed when a cover is deployed across a pool or tank by friction between the device and the cover causing a portion of the device to travel, in some instances at the end of a pivoting arm, out to a central region within the cover where water may accumulate. Water, temperature and other sensors may be used together with appropriate control devices to enhance operation of such water removal devices.

DETAILED DESCRIPTION

Figure 1:
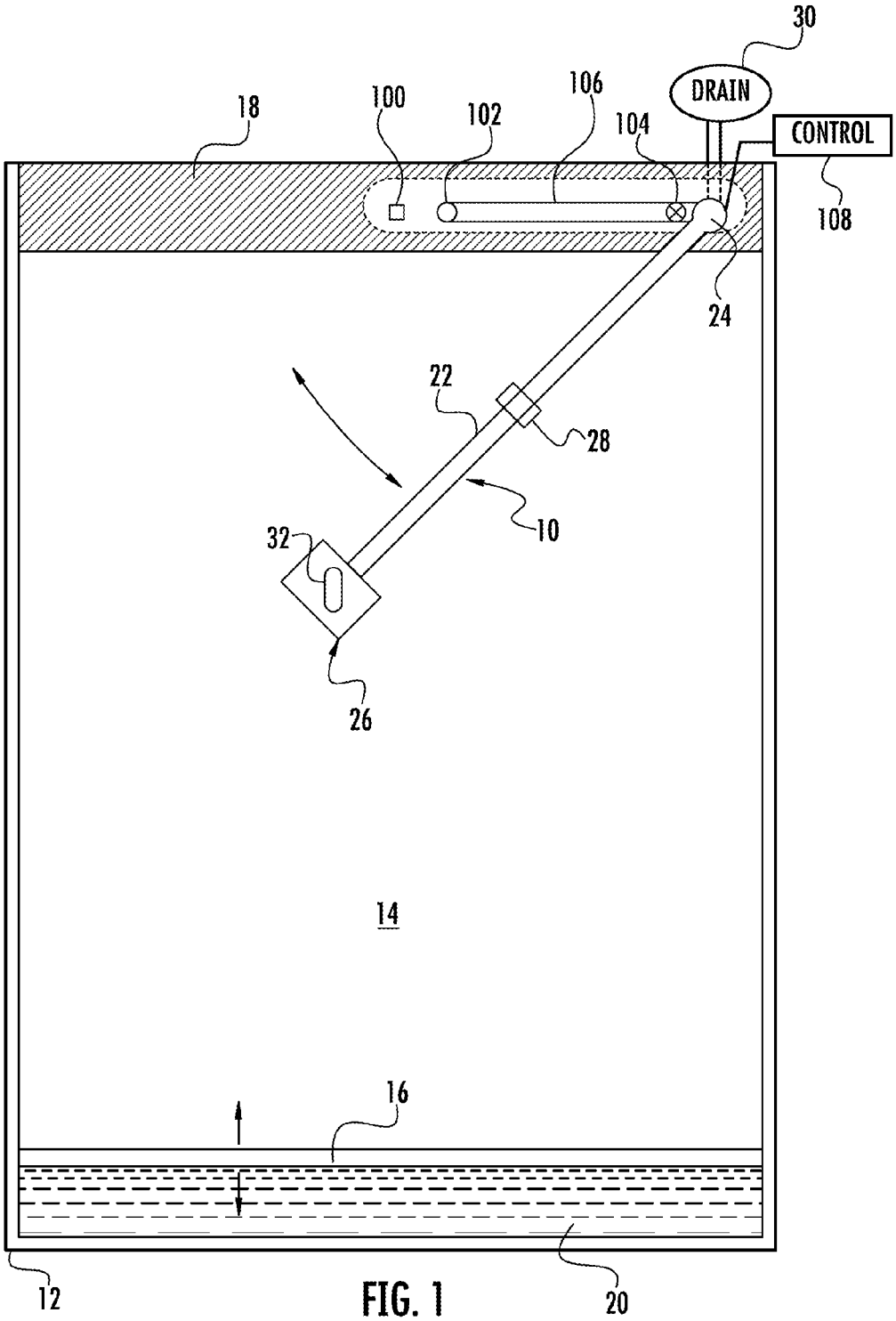
FIG. 1 is a partially schematized plan view of a water removal apparatus of this disclosure.

FIG. 1 illustrates an exemplary swimming pool 12 having a cover 14 with a cover leading edge 16 shown not quite fully deployed, so that water 20 may be seen in the pool near the bottom of FIG. 1. When the cover 14 is retracted, it may be stored under a vault 18. The schematized water removal apparatus 10 depicted in FIG. 1 includes a generally rigid arm 22 attached at one end to a pivot structure 24 and having a pump head structure 26 attached to the other end of arm 22. A knuckle joint 28 allows the pump head 26 to move vertically as may be necessary when water on cover 14 has formed a depression in cover 14. A pump (not shown in FIG. 1), typically in the vicinity of the pivot structure 24 draws water from the pump head through the arm 22 and discharges it into a drain 30. The pump may be actuated or turned on, and turned off, by control circuitry 108 (FIG. 1).

Pump head 26 automatically moves between its stored position within the vault 18 and its deployed position near the middle of cover 14 as cover 14 is stored or deployed. Such movement may be powered, power-assisted or solely as a result of friction between cover 14 and one or more wheels 32 mounted on pump head 26 and in contact with cover 14. Such wheel or wheels 32 located at an appropriate angle such that contact with the cover exerts force on the pump head 26 causing it to move in the same general direction as the cover 14 is moving. This causes the pump head 26 to pivot out of the vault 18 when cover 14 is being deployed on the pool 12 and back into the vault 18 when the cover 14 is being stored. The most force will be exerted on pump head 26 by one or more wheels 32 when the axis of rotation of wheel 32 is parallel to, or at a fairly small fraction of ninety degrees)(90° relative to, the direction of movement of cover 14. As the axis of rotation of the wheel(s) comes close to or is fully transverse (i.e., at ninety degrees))(90° to the direction of movement of cover 14, the wheels will just rotate freely and exert little force on pump head 26.

A second drain inlet 102 located within vault 18 may be coupled by a pipe 106 to a valve 104 also controlled by control 108 when desired to withdraw water that has accumulated within the vault 18 and discharge it into drain 30. Among other alternatives, valve 104 and the pump may be actuated in response to a signal from water a sensor 100 within vault 18. A valve may also be positioned between pump head 26 and the pump and controlled manually or by control 108.

Figure 2:
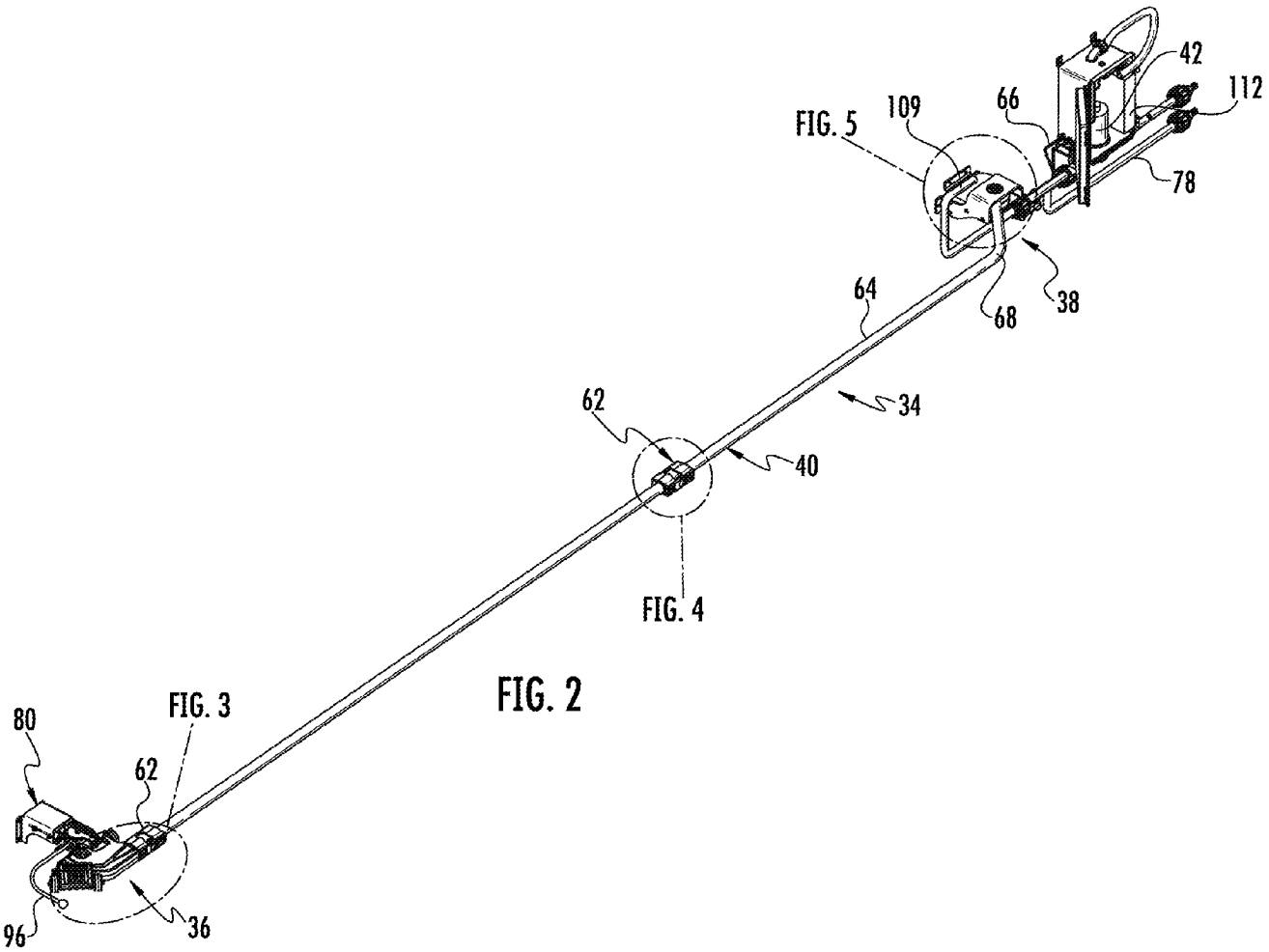
FIG. 2 is an isometric view of one embodiment of a water removal apparatus of this disclosure.
Figure 3:
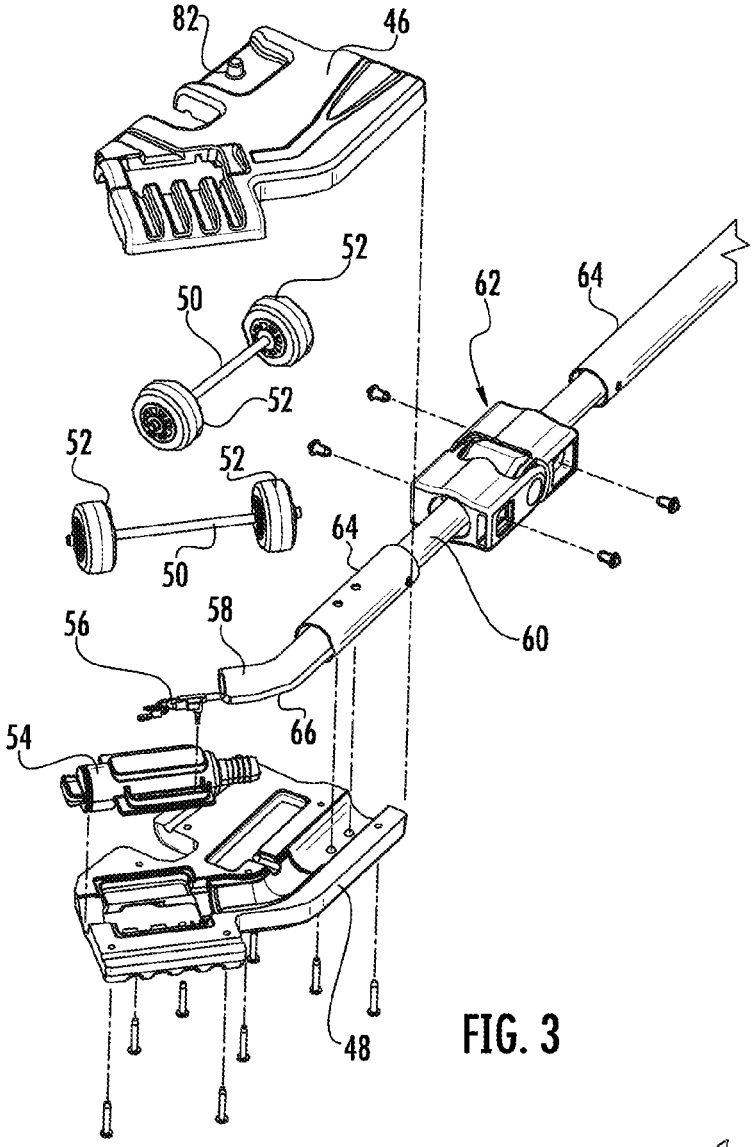
FIG. 3 is an enlarged exploded isometric view of the pump head portion of the apparatus shown in FIG. 2.

Another embodiment of a automatically deploying water removal apparatus of this disclosure is depicted as apparatus 34 in FIG. 2. Pump head 36 portion of apparatus 34 in FIG. 2 is depicted in an exploded isometric view in FIG. 3. As shown in FIG. 3, top head and bottom head castings 46 and 48 hold a nozzle assembly 54 that attaches to tubing end 58 that communicates through tubing 60 and with pump 42 (visible in FIG. 2). Top and bottom head castings 46 and 48 also trap axles 50 of two pairs of wheels 52, as may be appreciated by FIG. 3. The head castings 46 and 48 also hold a sensor 56 which may include a water sensor, a temperature sensor and possibly other sensors such as a motion detector. Sensor 56 is attached to a control located, for instance and among other alternatives, within an alternating current (ac) to direct current (dc) converter and control box 108 (near pump 42 in FIGS. 2 and 7), through cable 66 that runs outside of tubing 60 but inside of pipe arm 64. Pipe arm 64 may be a rigid material such as a metal or rigid plastic tube or pipe that encircles the tubing 60. Alternatively, a flexible tube 60 and any cables could be secured with straps or the like to a rigid rod as an alternative to a rigid tube or pipe. Pipe arm 64 may not be needed if the tubing 60 itself is sufficiently rigid.

As can be seen in FIGS. 2 and 3, the pairs of wheels 52 have axles 50 mounted at a significant angle to each other. This facilitates the exertion of appropriate forces on pump head 36 by contact with cover 14 at different points in the travel of pump head 36 and during different directions of cover travel (opening or closing).

Figure 4:
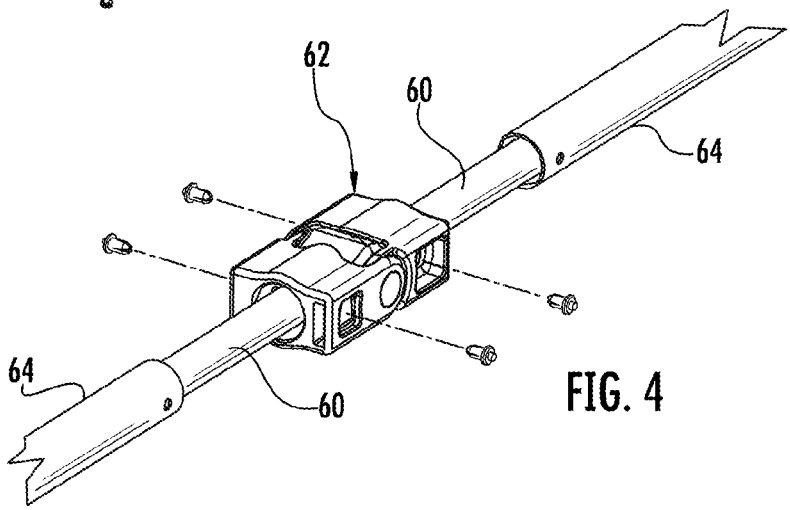
FIG. 4 is an enlarged isometric view of a knuckle hinge assembly shown in FIG. 2.

Nozzle assembly 54 may also include a water filter through which the water being removed is drawn. Pump head 36 is attached to arm 40 by means of tubing 60 and pipe arm 64, as well as knuckle assemblies 62 adjacent to pump head 36 and intermediate pump head 36 and pivot structure 38. The knuckle assemblies 62, as is illustrated in FIG. 4 allow fluid-tight fluid communication between tube 60 on opposite ends of the knuckle 62 while permitting articulation in a vertical plane.

Water sensor functionality in sensor 56 in pump head 36 can be used to turn on the pump 42 when water is present on the pool cover 14 and to turn the pump 42 off when no more water is sensed on the cover. A water sensor with or near pump 42 may also be desirable to sense the absence of water while water is still present on cover 14 because, for instance, the filter in nozzle assembly 54 has become clogged. This may permit control circuitry to switch pump 42 off so that it will not be damaged by running "dry." Furthermore, a water sensor 100 in FIG. 1 can be used by control circuitry in ac to dc converter and control box 108 to control valves (such as valve 104) so that water is removed from within vault 18 or some other location from which water removal is desirable.

Figure 5:
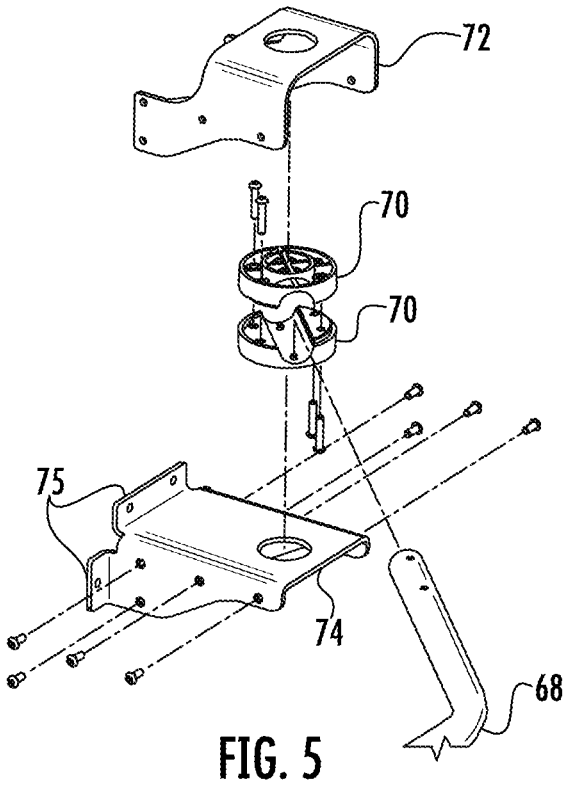
FIG. 5 is an enlarged exploded isometric view of the pivot apparatus shown in FIG. 2.
Figure 7:
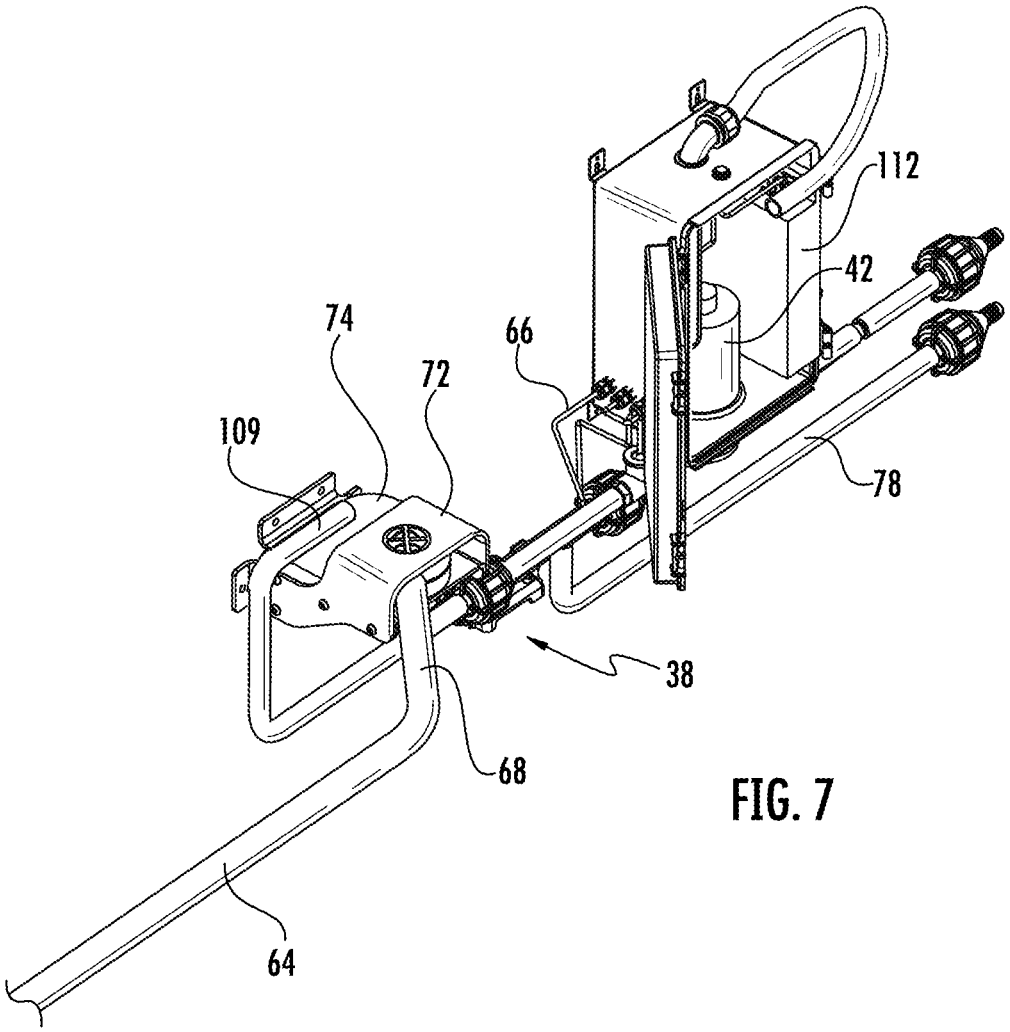
FIG. 7 is an enlarged isometric view of the pump and pivot portions of the water removal device of FIG. 2.

As may be appreciated by reference to FIGS. 5 and 7, pivot structure 38 attaches to arm 40 (shown in FIG. 2) by capturing a portion 68 of pipe arm 64 (shown in FIGS. 2 and 7) between two pivot bearings 70 that rotate within an upper bearing plate 72 and a lower bearing plate 74. As depicted in FIGS. 5 and 7, bearing plate 74 is adapted for mounting to structure not shown by passing bolts or other appropriate fasteners (not shown) through flanges 75 and into such structure. Flexible tubing (not shown) communicates between the tubing within pivot bearings 70 and pump 42 inlet 109 so that water can be drawn through the pivot. Cable 66 communicates with control circuitry within an ac to dc convertor and control box 108. Tubing 78 may be an alternative drain line for draining an area within the vault (as depicted schematically in FIG. 1.).

Figure 8:
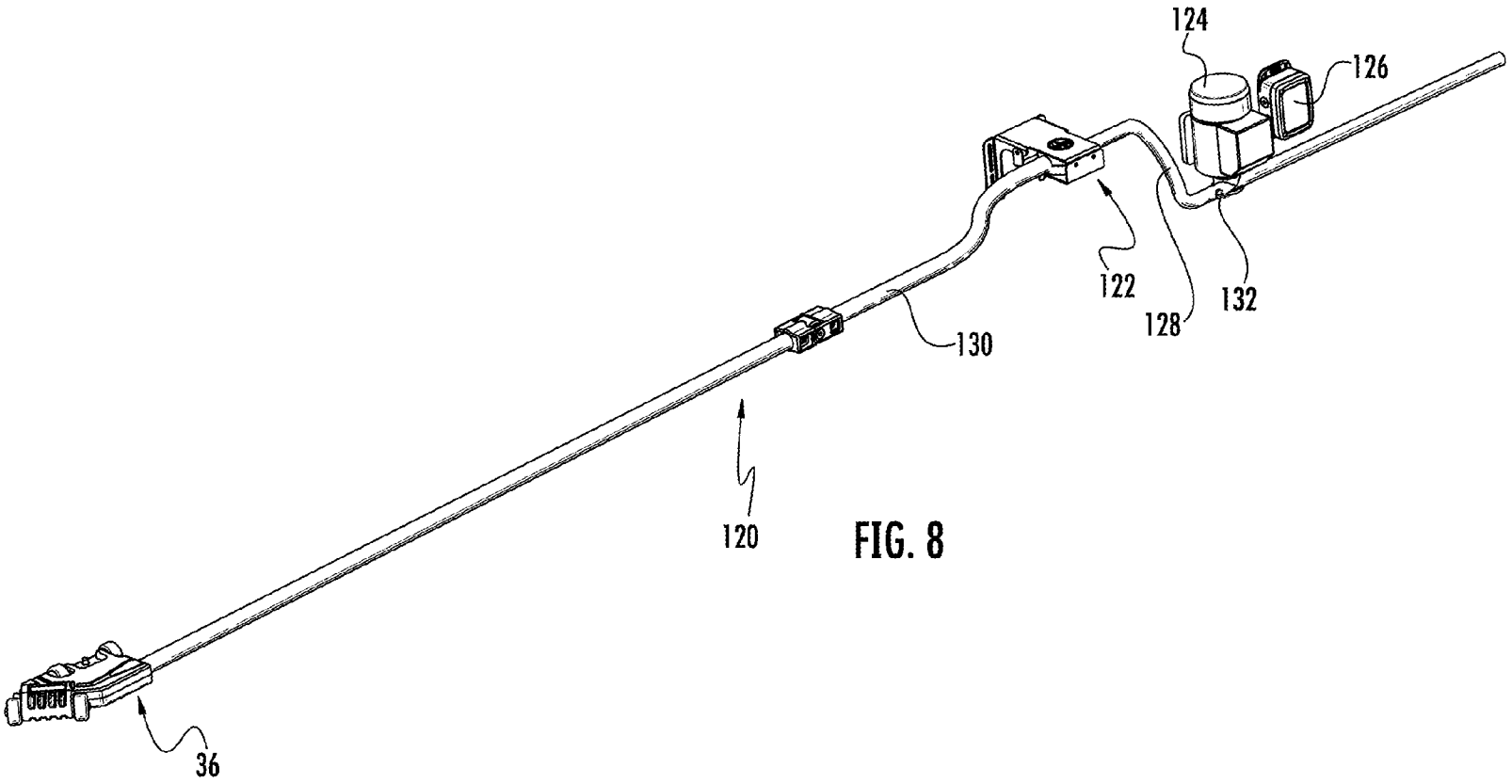
FIG. 8 is an isometric view of another embodiment of a water removal apparatus of this disclosure.

In an alternative embodiment depicting a water removal apparatus 120 in FIG. 8, the same pump head 36 is used as in FIG. 2, but a different but similar pivot structure 122 is utilized together with an ac pump 124 and a controller 126. (No docking station is depicted in FIG. 8.) Flexible tubing 128 may be used to accommodate the rotation of the arm 130 about pivot structure 122. A water detection sensor 132 just "upstream" from pump 124 can communicate the presence or absence of water to control the pump 124 to prevent damage to it from running "dry."

Figure 6:
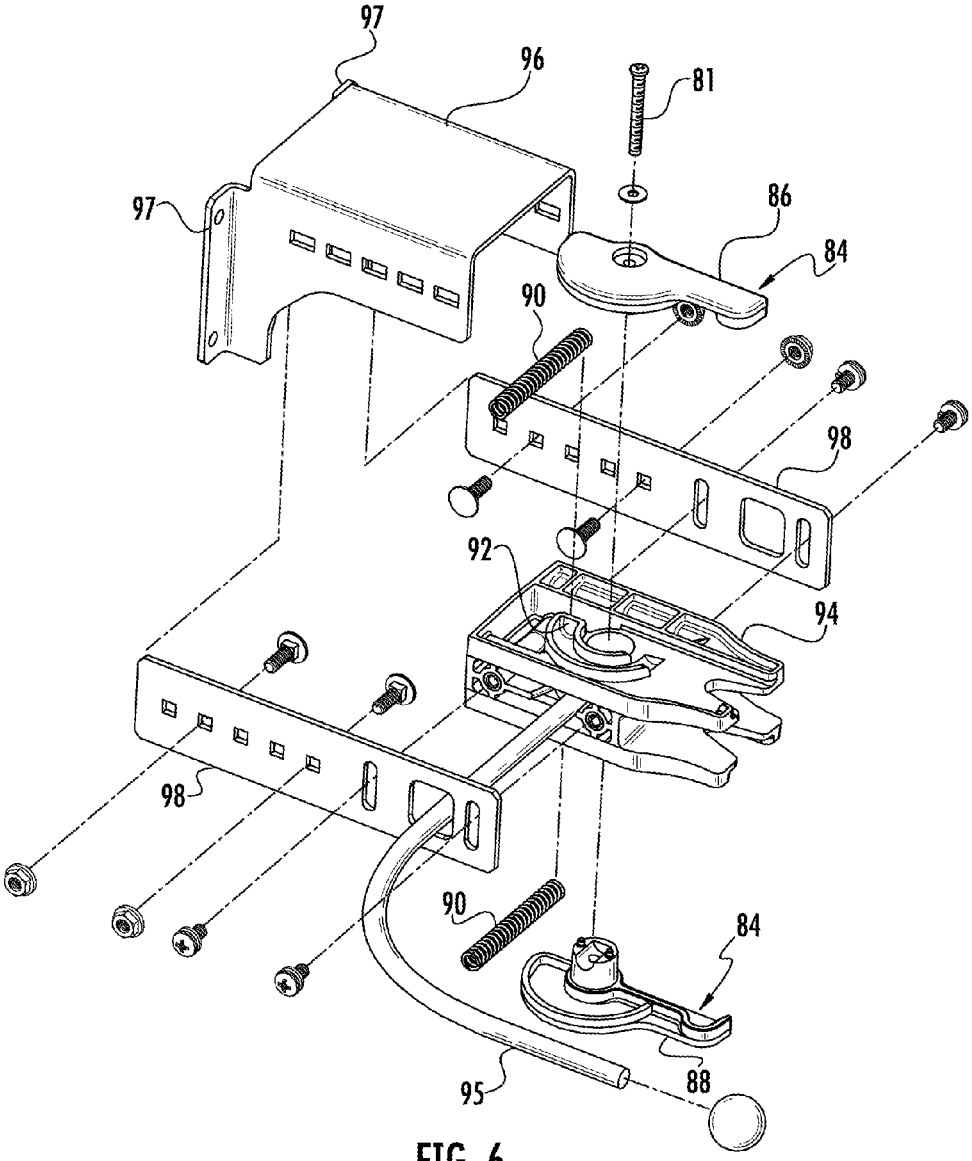
FIG. 6 is an enlarged exploded isometric view of an optional docking station attached to the pump head in FIG. 2.

An optional docking station 80 visible in FIG. 2 is further illustrated in FIG. 6. In docking station 80, a mounting dock 94 (that may be molded of plastic, among other alternatives) is secured to a mounting bracket 96 with plates 98, and bracket 96 may be attached to structure not shown with bolts or other fasteners, not shown, passing through flanges 97 and into that structure.

Top unlock pivot 86 and bottom unlock pivot 88 are mounted on mounting dock 94 and can rotate slightly about a bolt 81. Coiled compression springs 90 secured in openings 92 (only one opening is visible in FIG. 6) in mounting dock 94 biases pivots 86 and 88 in a counter clockwise direction as viewed from the top of FIG. 6. Pivots 86 and 88 have recesses 84 for receiving pins 82 on the top and bottom head castings 46 and 48 (pins 82 may be seen on the top head casting 46 in FIG. 3). When pins 82 are in recesses 84, pump head 36 is secured in its docked position (as depicted in FIG. 2).

Pressure exerted on arm 95 by, for instance, as a pool owner rotates pivots 86 and 88 out of contact with pins 82 when pump head 36 and arm 40 are to be released and pivoted out to their deployed position with pump head 36 in a central region of pool cover 14 as is depicted in FIG. 1.

Arm 22 or 26 could also be biased toward its deployed position by a spring or other force-exerting component to facilitate deployment of arm 22 or 26 when the cover 14 is deployed. While friction between a retracting cover 14 and the wheels 52 may not cause such a spring-loaded arm to retract or to retract fully, contact between the pool cover edge 16 and pump head 26 or 36 should nevertheless drive the pump head and attached arm into their stored position.

Friction between moving pool cover 14 as it is deployed and wheels 52 causes the desired pivoting action driving pump head 26 or 36 out to its deployed position. Friction exerted in the opposite direction when pool cover 14 is closed likewise tend to urge pump head 26 or 36 and arm 22 or 64 to a stored position, typically within vault 18. If such friction is inadequate to fully store the water removal apparatus, contact between pool cover edge 16 and pump head 26 or 36, as the case may be, will forced the pump head and attached arm into their closed positions.

While the wheels 32 or 52 depicted in FIGS. 2, 3 and 7 are not powered and simply rotate as result of contact with the pool cover against which they rest, in alternative embodiments, the wheels 32 or 52 could be powered to assist in deployment as described above or to enable deployment or storage of the pump head to occur without or separately from cover movement. Movement of arm 22 or 64 between stored and deployed positions could also be achieved or facilitated by force exerted on the arm 22 or 64 by an appropriate electrical or hydraulic rotary motor or one or more hydraulically actuated piston(s), among other alternatives.

In addition to the water sensor 56 visible in FIG. 3, which is associated with pump head 36, a water sensor 100 (shown in FIG. 1) may be located in a location within vault 18 (shown in FIG. 1) where water accumulates, and a water inlet 102 (shown in FIG. 1) communicating with a valve 104 (shown in FIG. 1) through a pipe 106 (shown in FIG. 1) may be used to remove such water within the vault by controlling valve 104 and the pump to draw water from inlet 102, when desired, rather than from pump head 36. Additionally, a water sensor may be located proximate the pivot structure 24 or 38 or integrated with the pump 42 to sense the absence of water because the filter as part of nozzle assembly 54 has become clogged, all the water has been removed from pool cover 14, or for any other reason so that pump 42 can be shut off.

Other sensors can also be used such as a sensor detecting motion of pump head 26 or 36 consistent with a person or animal having fallen onto the pool cover.

A temperature sensor as part of sensor 56 (shown in FIG. 3) or located elsewhere may be coupled to the control 108 (shown in FIG. 1) to prevent pump operation below certain temperatures at which the water may be frozen to prevent damaging operation of the pump.

Alternative structures and components are possible such as embodiments of this disclosure in which the water pump is integrated with the pump head 26 or 36 or is in some other location, rather than being located proximate the pivot structure 24 and 38, as depicted in the Figures. As reflected in the different embodiments described above, one pump 42 uses a direct current (dc) motor and the other pump 124 uses an alternating current (ac) motor. Different types of, and differently powered, pumps can also be used.

Figure 9:
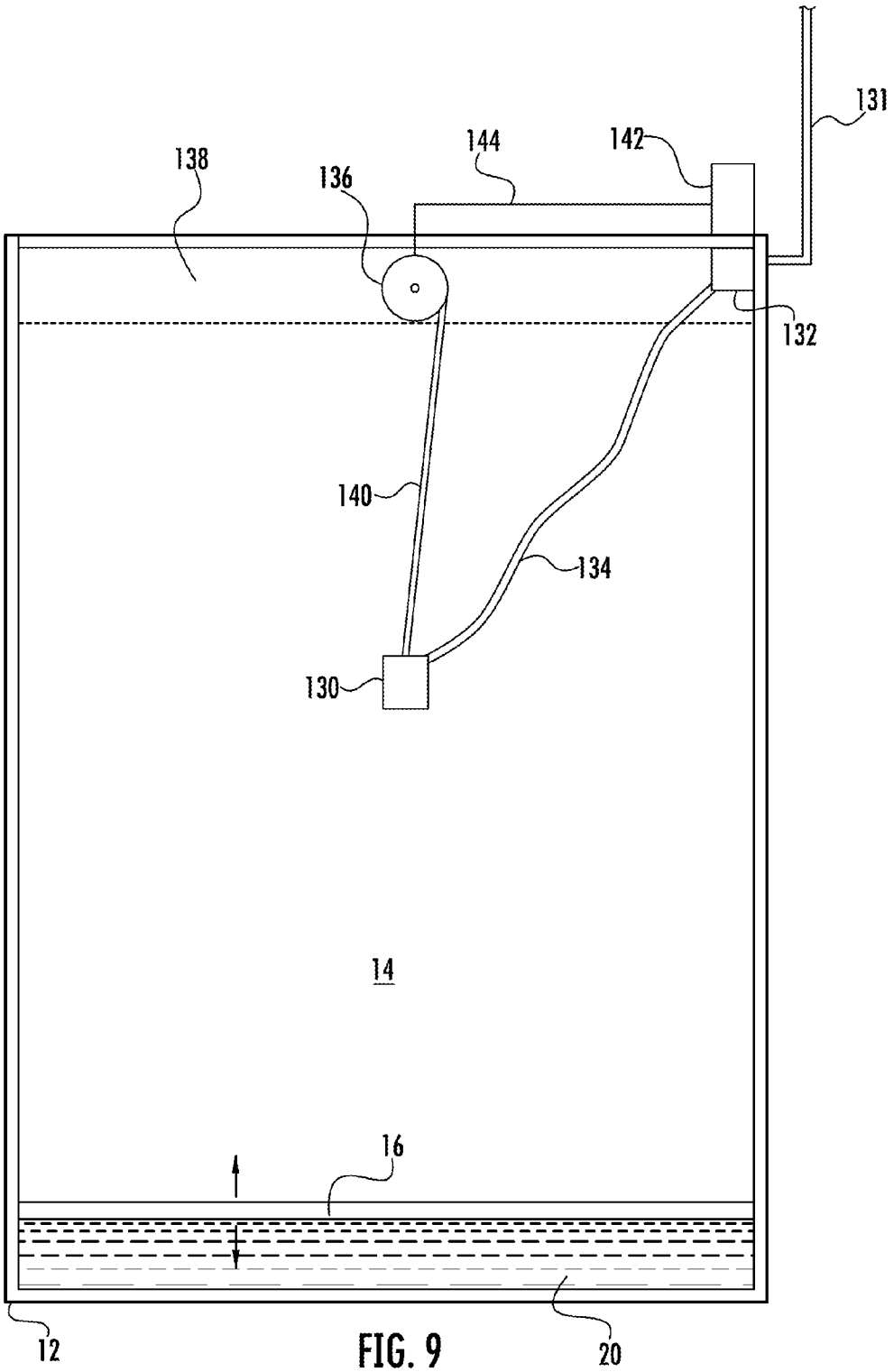
FIG. 9 is a partially schematized plan view of an alternative water removal apparatus of this disclosure.

Illustrating another embodiment, FIG. 9 is a schematized plan view of pool 12 (also shown in FIG. 1) having cover 14 and cover edge 16 shown almost fully deployed over the water 20. In this embodiment, pump head 130 does not pivot on the end of a rigid pipe or other structure, and, as a result, no long, rigid pipes, rods or other potentially difficult-to-ship components are needed. Instead, pump head 130 is in communication with a pump 132 (that discharges into a drain 131) by a flexible pipe or hose 134. Pump head 130 is tethered to a reel 136 within vault area 138 by a rope, cable, line or cord 140 that limits pump head 130 travel beyond approximately the middle of the pool cover. Pump head 130 travels along with the pool cover 14 during pool cover deployment so that pump head 130 is in approximately the middle of the pool cover 14 when the cover is fully deployed, as is almost the case in FIG. 9. During such deployment of the pool cover 14 and pump head 130, cord 140 is permitted to spool out of reel 136 until pump head 130 reaches a predetermined distance away from the vault area 138 with the pump head approximately in the middle of pool cover 14 (or some other desired location). When pool cover 14 is retracted into vault area 138 in order to make pool 12 usable, pump head 130 likewise retracts into the vault area 138, and cord 140 helps insure that pump head is appropriately positioned for proper deployment the next time the cover 14 is deployed.

Multiple reel 136 and retraction mechanisms are possible. For instance, reel 136 can be used solely for retracting cord 140 when pool cover 14 is stored, in which event, guided by cord 140, pump head 130 moves back into the middle of vault area 138 as a result of friction between pump head 130 and cover 14 and as a result of contact between pump head 130 and cover leading edge 16. In this case, reel 136 can simply contain a spring mechanism that retracts the cord 140 when the pump head 130 moves toward the vault area 138.

Alternatively, reel 136 can contain a retraction mechanism powered and controlled by control box 142 to which reel 136 is attached by cable 144. Such a retraction mechanism may cause cord 140 to be retracted into the reel 136, thereby pulling pump head 130 back to the vault area 138. In this alternative, the pump head 130 can be retracted separately while the cover 14 remains deployed.

In another alternative, cord 140 can include a power, sensor and/or control cable that provides power to pump head 130 so that a pump can be located in pump head 130 and data can be provided to the control box 142 from sensors in or on pump head 130. In yet another alternative, one or all of such power, sensor and control cables may be positioned along with flexible pipe 134 or may travel separately to pump head 130 rather than along either of flexible pipe 134 or cord 140.

In alternatives in which power is supplied to pump head 130, pump head 130 can include a powered deployment mechanism, such as powered wheels, that can move pump head 130 out onto the cover 140 after cover 140 has already been deployed.

The sensors described above may be of any appropriate type for determining the conditions of interest, including without limitation electronic, magnetic, and electro-mechanic (e.g., float-type water) sensors. Such sensors and other system elements can be coupled to control circuitry through cables, but wireless coupling could also be employed, for instance, using existing wireless technology such as Wi-Fi, Bluetooth or infrared technology or using future wireless technologies.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A water removal apparatus for removing water from a water-impermeable, flexible swimming pool cover that may be deployed to cover a pool or refracted to uncover the pool, wherein a movable leading edge structure is attached to the cover, the apparatus comprising:

a head, a pivot, an arm having two ends, one of which is attached to the pivot and the other of which is attached to the head, a water inlet attached to or a part of the head, a pump proximate the pivot, at least one tube for conveying water from the water inlet to the pump, at least one wheel attached to the head and adapted for contact with the cover, wherein contact between the at least one wheel and the cover, as the cover is deployed, causes the arm to pivot from a stored position to a deployed position and wherein contact between the leading edge and the head when the cover is retracted to a stored position at least helps move the arm back to the stored position.

2. The water removal apparatus of claim 1, further comprising a filter proximate the water inlet and through which water is drawn.

3. The water removal apparatus of claim 1, further comprising a sensor mounted on the head.

4. The water removal apparatus of claim 3, wherein the sensor senses water and is operatively coupled to a control for actuating the pump when water is sensed.

5. The water removal apparatus of claim 4, further comprising a temperature sensor operatively coupled to the control for preventing pump actuation when the sensor detects a temperature below a selected temperature.

6. The water removal apparatus of claim 1, further comprising a manually actuated docking station for securing the head and the arm in the stored position.

7. The water removal apparatus of claim 3, further comprising a second sensor for sensing water in a second location and controlling the pump to be actuated to remove water from the second location.

8. The water removal apparatus of claim 7, further comprising a control to actuate water removal from one of the two locations before removal from the other of the locations.

9. The water removal apparatus of claim 3, further comprising a second sensor for sensing an absence of water flow through the pump and controlling the pump to de-actuate the pump in the absence of water.

10. The water removal apparatus of claim 1, further comprising at least one knuckle joint in the arm to permit the head to move vertically.

11. A water removal apparatus for removing water from a water-impermeable, flexible swimming pool cover that may be deployed to cover a pool or retracted into a vault to uncover the pool, wherein a movable leading edge structure is attached to the cover, the apparatus comprising:

a head, a pump control, a sensor attached to the head for sensing a presence of water and communicating with the control, a pivot, a structural tubing arm having two ends, one of which is attached to the pivot and the other of which is attached to the head, a water inlet attached to or a part of the head, a pump operatively attached to the pump control, at least one water tube for conveying water from the water inlet to the pump, two pairs of wheels attached to the head and adapted and positioned for contact with the cover, wherein deployment of the cover causes the arm to pivot from a stored position to a deployed position and wherein contact between the leading edge and the head when the cover is retracted to a stored position at least assists in moving the head and arm back to the stored position.

* * * * *